US011490665B2

(12) United States Patent
DeSalvio et al.

(10) Patent No.: US 11,490,665 B2
(45) Date of Patent: Nov. 8, 2022

(54) METHOD FOR INSERTING AND REMOVING CLOTHING INSERT PADS

(71) Applicants: Matthew Vincent DeSalvio, San Dimas, CA (US); Gina Marie DeSalvio, San Dimas, CA (US)

(72) Inventors: Matthew Vincent DeSalvio, San Dimas, CA (US); Gina Marie DeSalvio, San Dimas, CA (US)

( * ) Notice: Subject to any disclaimer, the term of this patent is extended or adjusted under 35 U.S.C. 154(b) by 747 days.

(21) Appl. No.: 16/381,015

(22) Filed: Apr. 11, 2019

(65) Prior Publication Data

US 2020/0323281 A1 Oct. 15, 2020
US 2022/0312857 A9 Oct. 6, 2022

Related U.S. Application Data

(60) Provisional application No. 62/656,320, filed on Apr. 11, 2018.

(51) Int. Cl.
*A41C 5/00* (2006.01)
*A41C 3/14* (2006.01)

(52) U.S. Cl.
CPC ..... *A41C 5/00* (2013.01); *A41C 3/144* (2013.01)

(58) Field of Classification Search
CPC ..... A41C 5/00; A41C 3/144
See application file for complete search history.

(56) References Cited

U.S. PATENT DOCUMENTS 5,511,674 A * 4/1996 Boyd ..... A47B 23/04 206/363

OTHER PUBLICATIONS

The cup claw introduction—youtube (Year: 2018).*

* cited by examiner

*Primary Examiner* — Amy R Weisberg

(57) ABSTRACT

Insert pads used in women's clothing can be difficult to insert, remove, or adjust. The application includes independent methods for each of these scenarios, which are significant improvements over the state-of-the art method of manually massaging into place. By using a specially designed tool with the method laid out herein, it is possible to accomplish these tasks with great effectiveness and in much less time than before.

3 Claims, 14 Drawing Sheets

METHOD FOR INSERTING AND REMOVING CLOTHING INSERT PADS

CROSS-REFERENCE TO RELATED APPLICATIONS

This application claims the benefit of PPA application number 62656320 filed Apr. 11, 2018 by the present inventors which is incorporated by reference.

BACKGROUND

Several different types of women's clothing may include a contoured insert pad (51) which is usually made of foam and is designed to smooth, shape, and conceal the details of the wearer's breast. These insert pads are located inside the breast cup lining (52) of clothing, brassieres, sports brassieres, or bathing suit tops. They are typically removable through a small slot or gap in the article of clothing's side seam (53), where the brassiere structure goes beneath the wearer's arm. Since the removable insert pads are often not affixed to the article of clothing in any way, they can fall out or become bunched up while storing, transporting, or laundering the clothing. Insertion and alignment of the insert pad can be very difficult and time consuming to achieve due to the fact that the access hole is usually quite small and located on the side seam of the article of clothing. This access hole is not located closely enough to where the pad will ultimately need to be placed so the fingers of most individuals are simply not long enough to manage this task effectively. Currently, the method suggested by merchants and manufacturers of these insert pads is to fold or roll it up, slide it into the article of clothing, and then massage the article of clothing from the outside to open, flatten and align the insert pad into place. This method is both time consuming and difficult to perform since it must be accomplished by feel alone. This is only compounded by the fact that many insert pads are orientation specific. Therefore, a need exists for novel means and methods by which a user will be capable of inserting these insert pads accurately into the article of clothing in a timely and efficient manner.

DRAWINGS—LIST OF FIGURES

Figure 1:
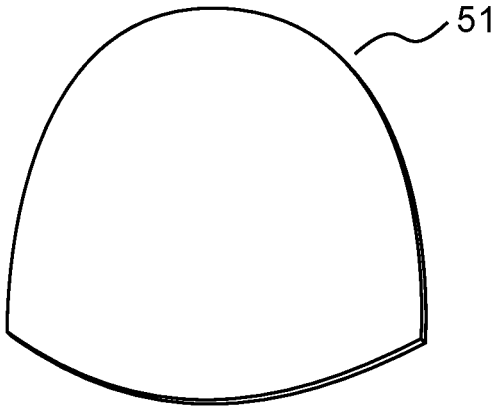

FIG. 1: A typical insert pad from a women's sports brassiere or similar article of clothing.

Figure 2:
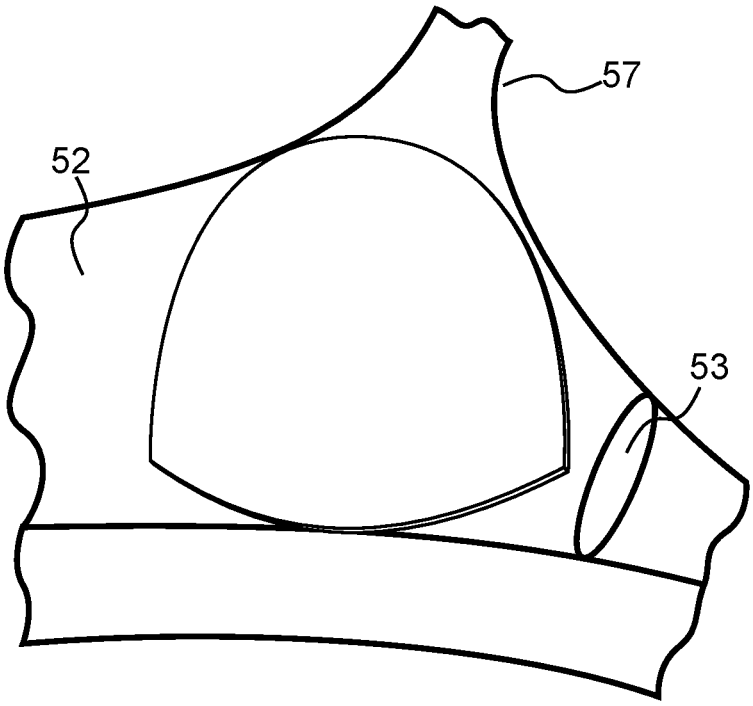

FIG. 2: Insert pad relative to the cavity in which it is placed and the hole through which it must be inserted.

Figure 3:
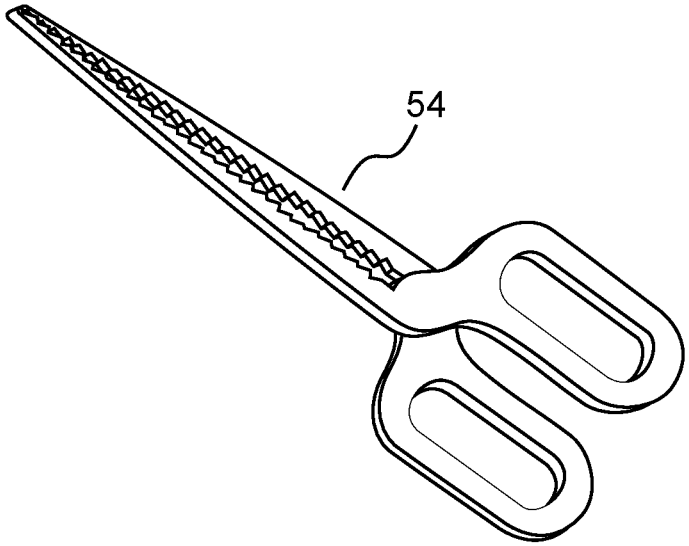

FIG. 3: A specially designed tool for inserting, removing or adjusting insert pads.

Figure 4:
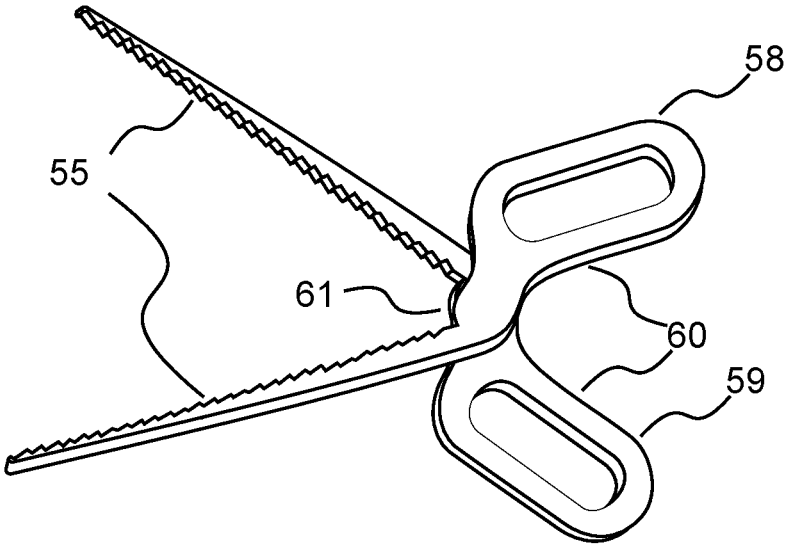

FIG. 4: The specially designed tool in its fully opened position.

Figure 5:
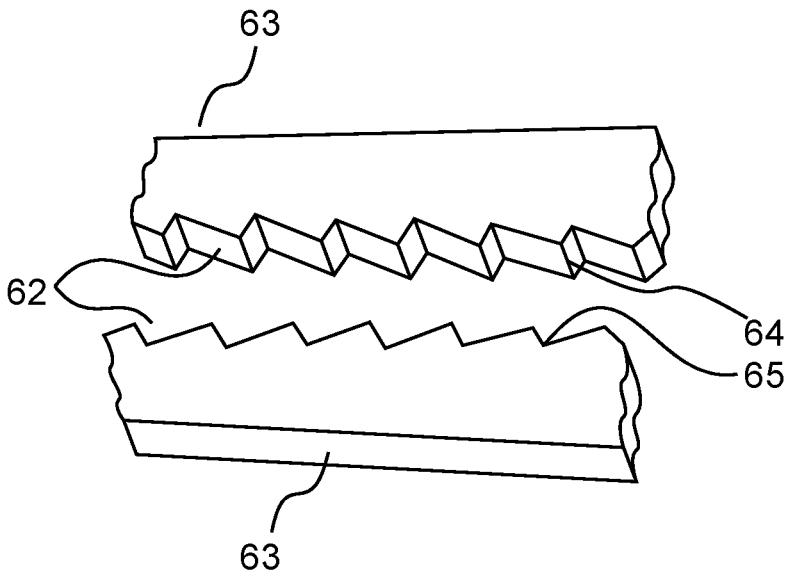

FIG. 5: Detailed view of the teeth present on the jaws of the tool.

Figure 6:
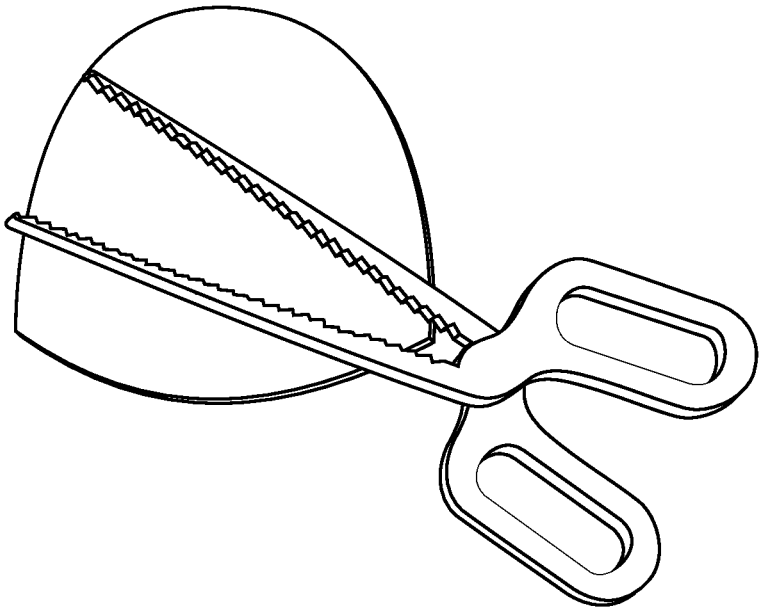

FIG. 6: Alignment of the tool relative to the insert pad for insertion into the article of clothing.

Figure 7:
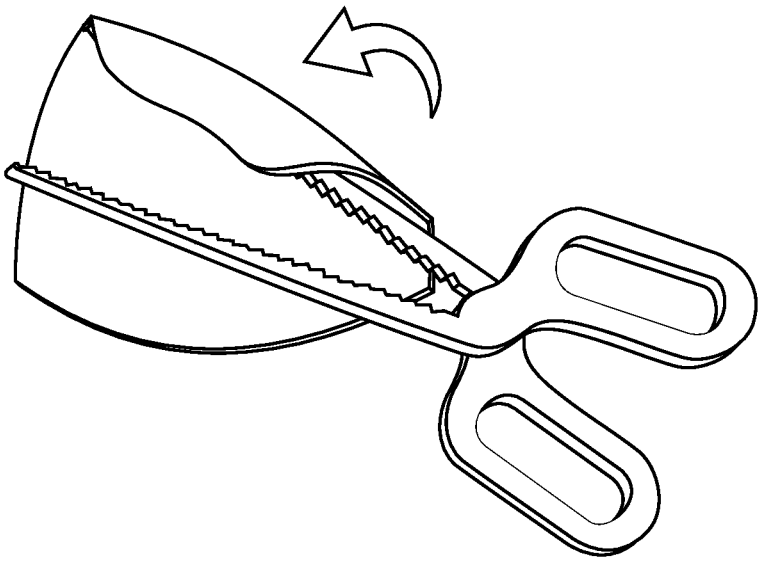

FIG. 7: Insert tool with the top portion of the insert pad wrapped around the upper jaw.

Figure 8:
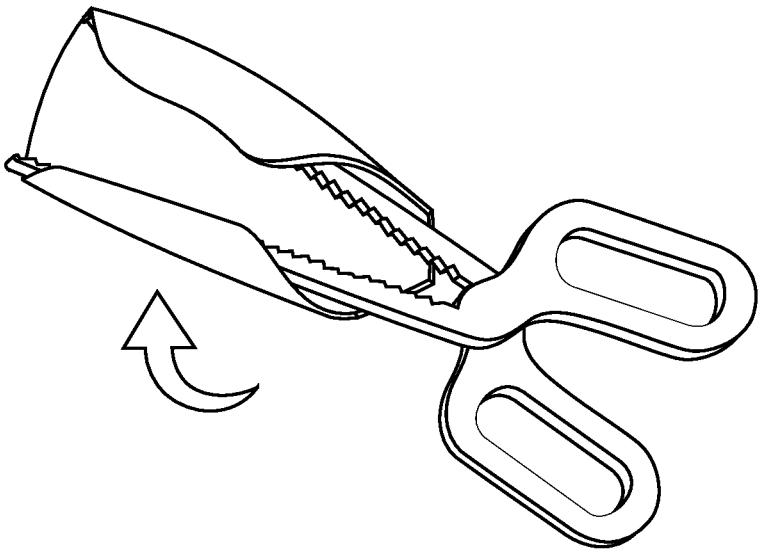

FIG. 8: Insert tool with the top and bottom portions of the insert pad wrapped around the jaws.

Figure 9:
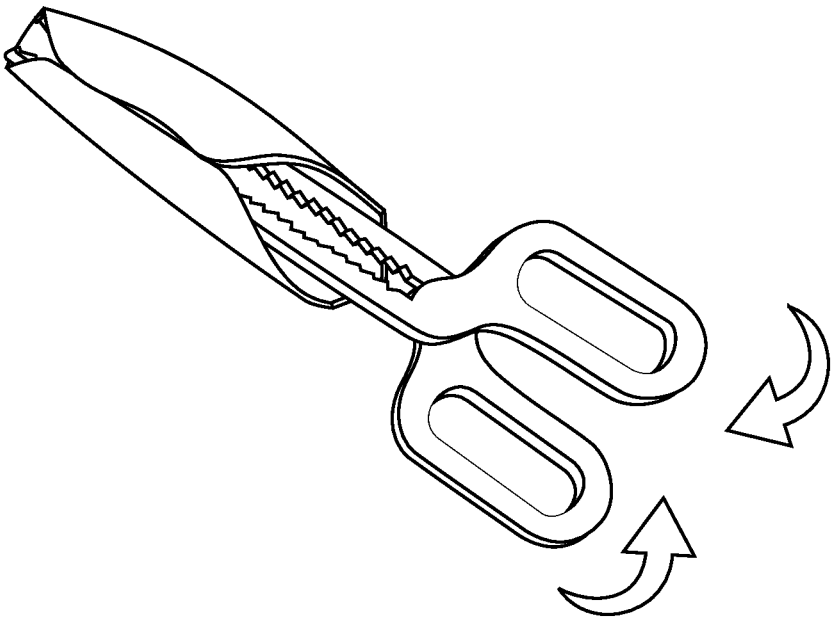

FIG. 9: Insert pad fully clamped in the tool and ready for insertion into the article of clothing.

Figure 10:
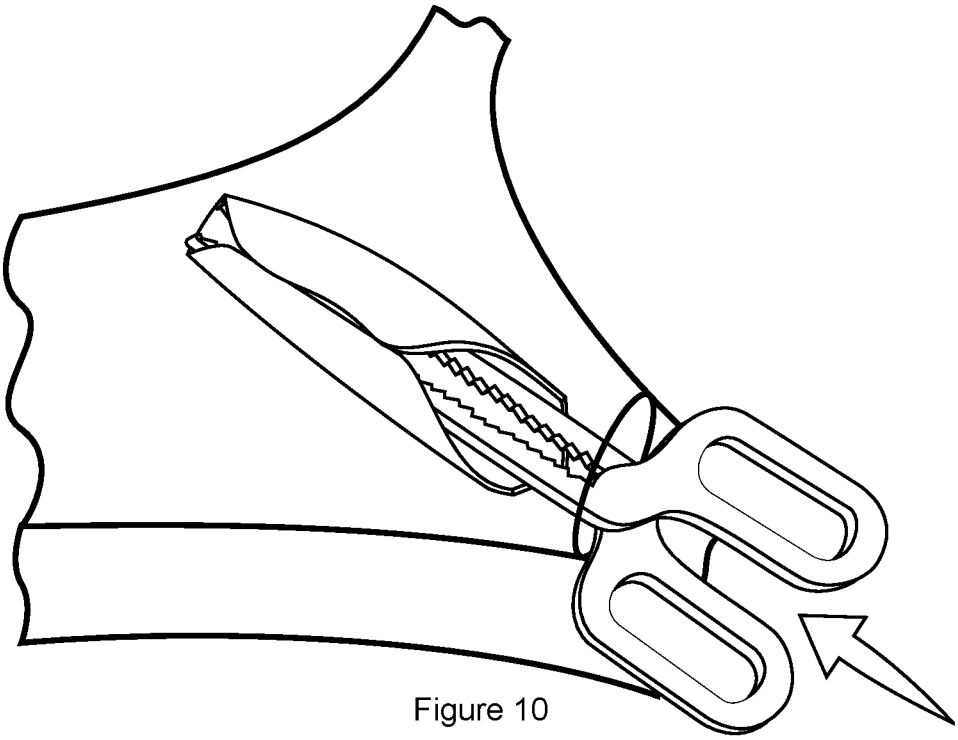

FIG. 10: Tool with clamped insert pad fully inserted into the article of clothing.

Figure 11:
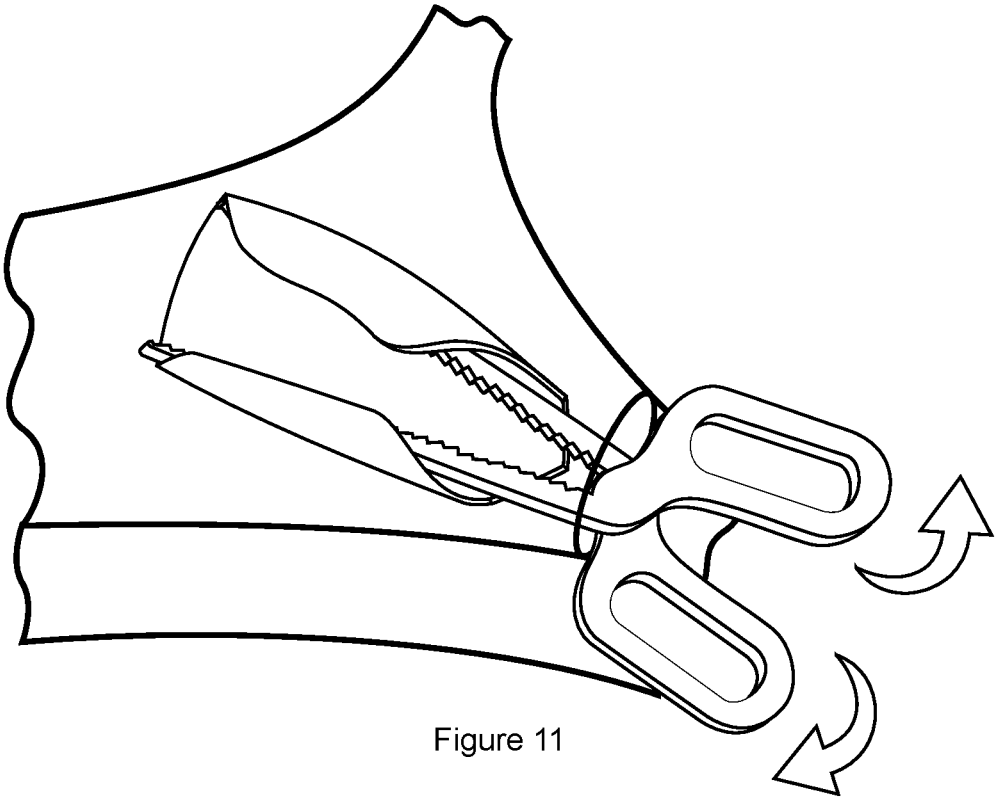

FIG. 11: Tool partially opened inside of the article of clothing.

Figure 12:
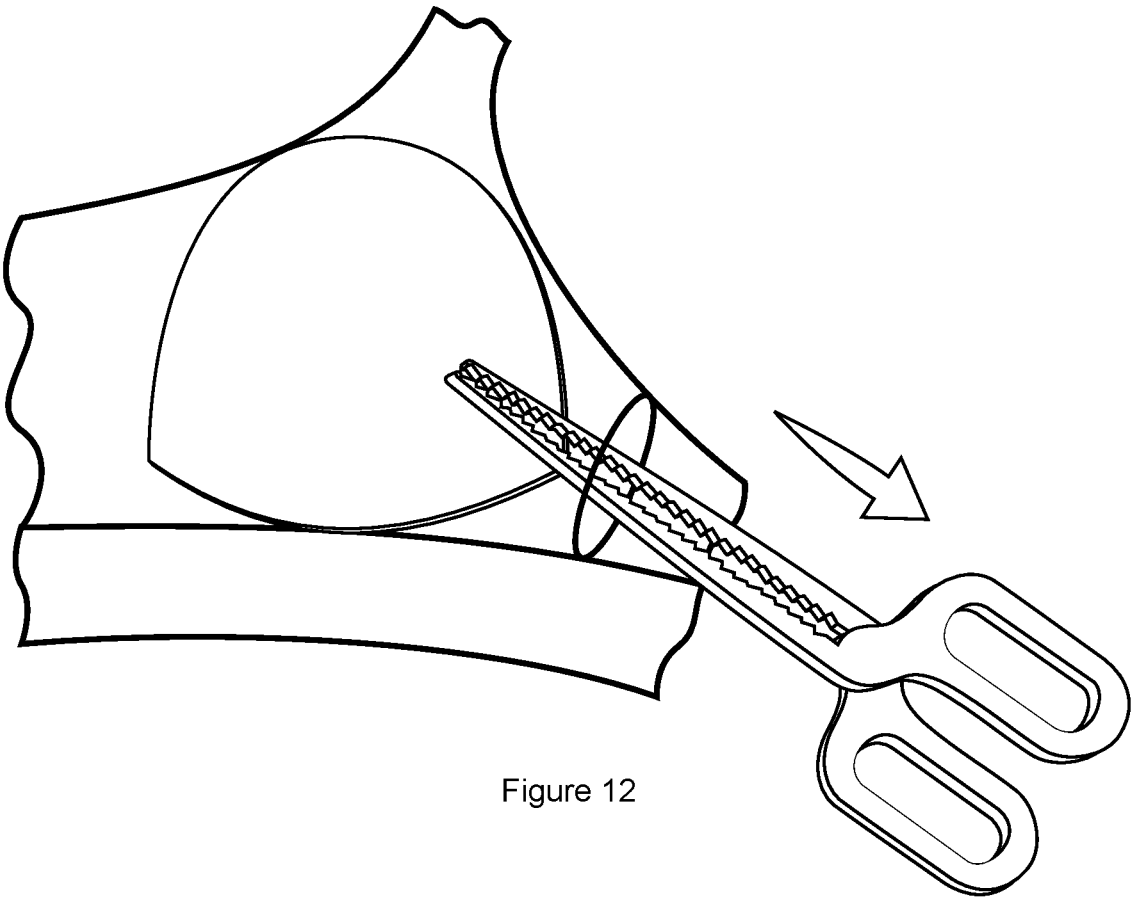

FIG. 12: Tool partially removed from the article of clothing, having just inserted the insert pad.

Figure 13:
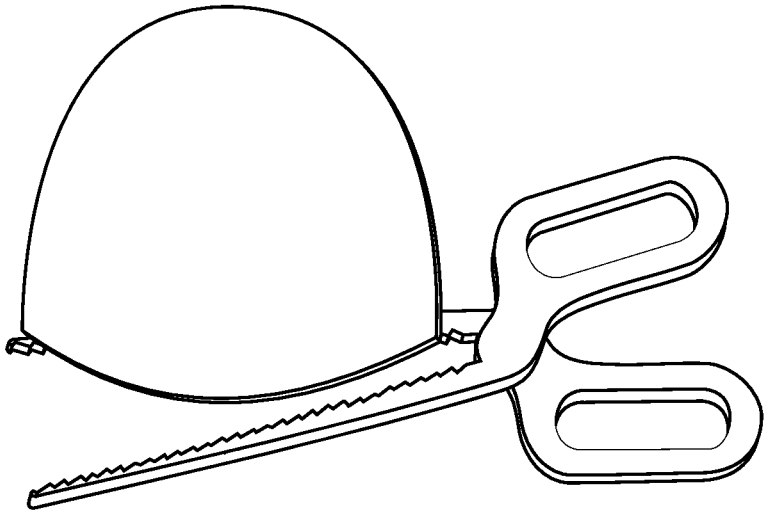

FIG. 13: Alternate alignment of the tool relative to the insert pad for insertion into the article of clothing.

Figure 14:
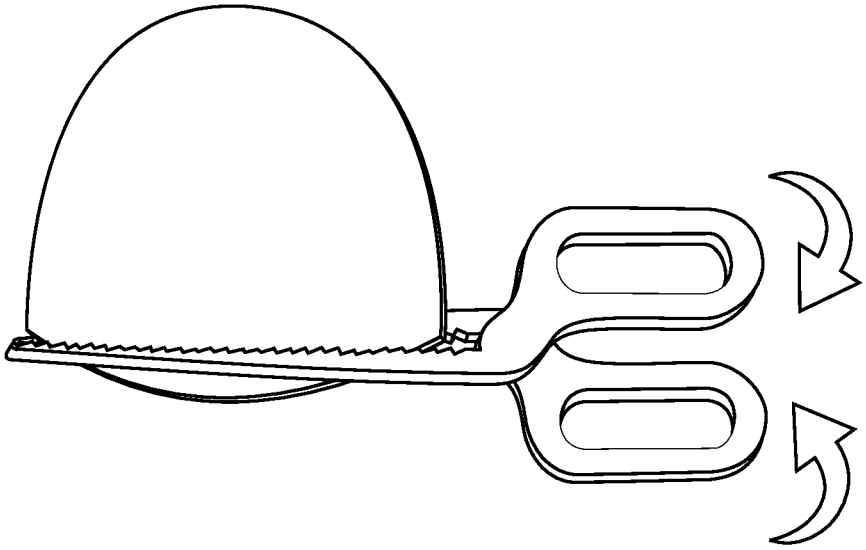

FIG. 14: Tool clamped onto the insert pad for the alternate insertion method.

Figure 15:
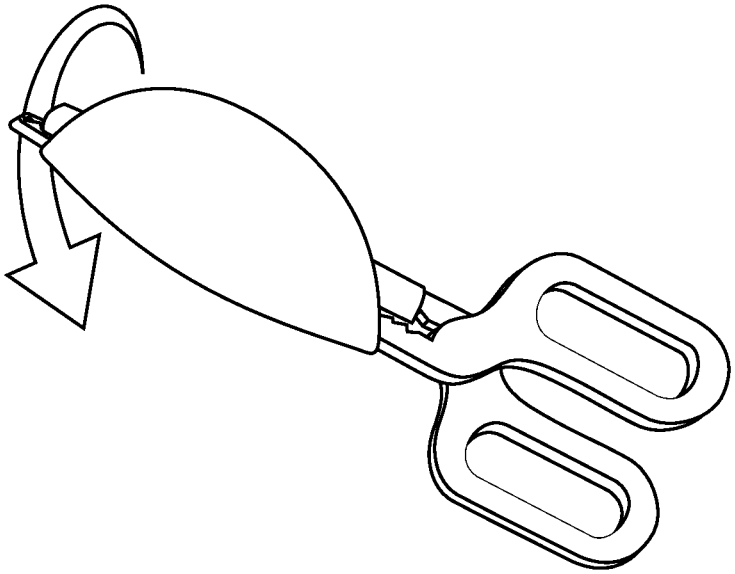

FIG. 15: Insert pad fully wrapped around the insert pad for the alternate insertion method.

Figure 16:
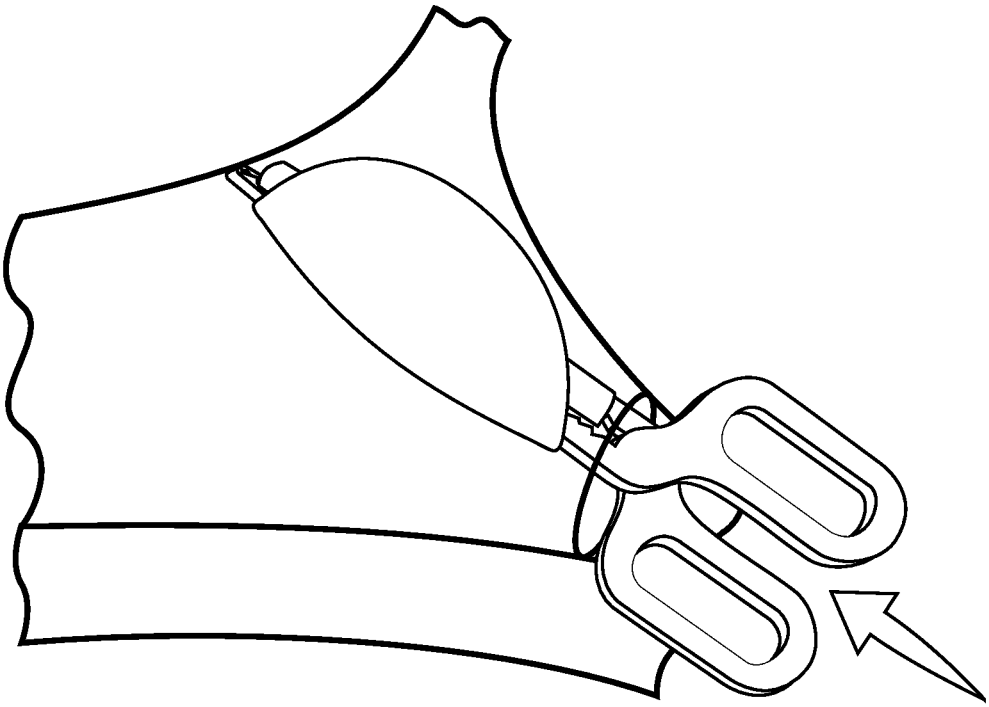

FIG. 16: Tool with clamped and wrapped pad fully inserted into the article of clothing for the alternate insertion method.

Figure 17:
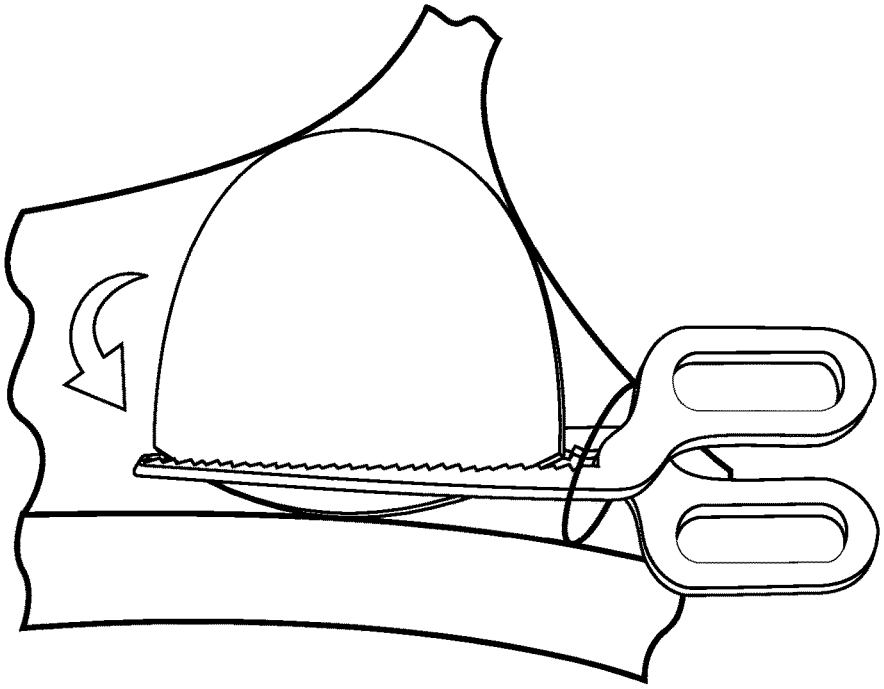

FIG. 17: Tool fully unwrapping the insert pad inside of the article of clothing for the alternate insertion method.

Figure 18:
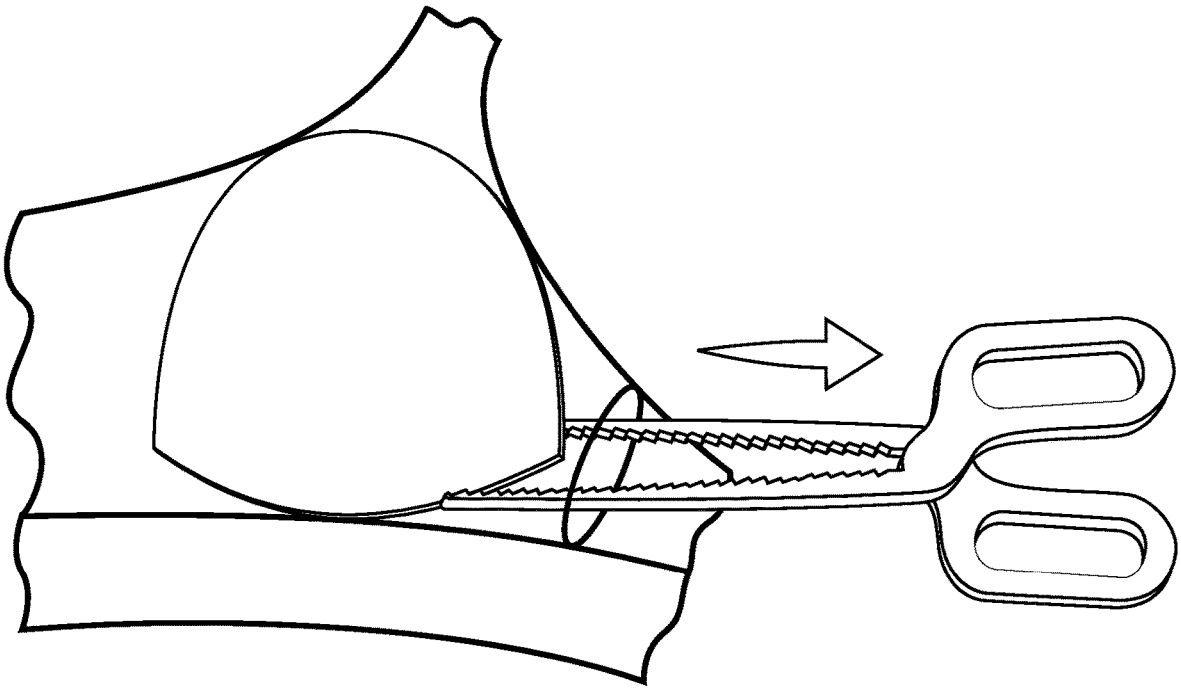

FIG. 18: Tool partially removed from the article of clothing, having just inserted the insert pad via the alternate insertion method.

Figure 19:
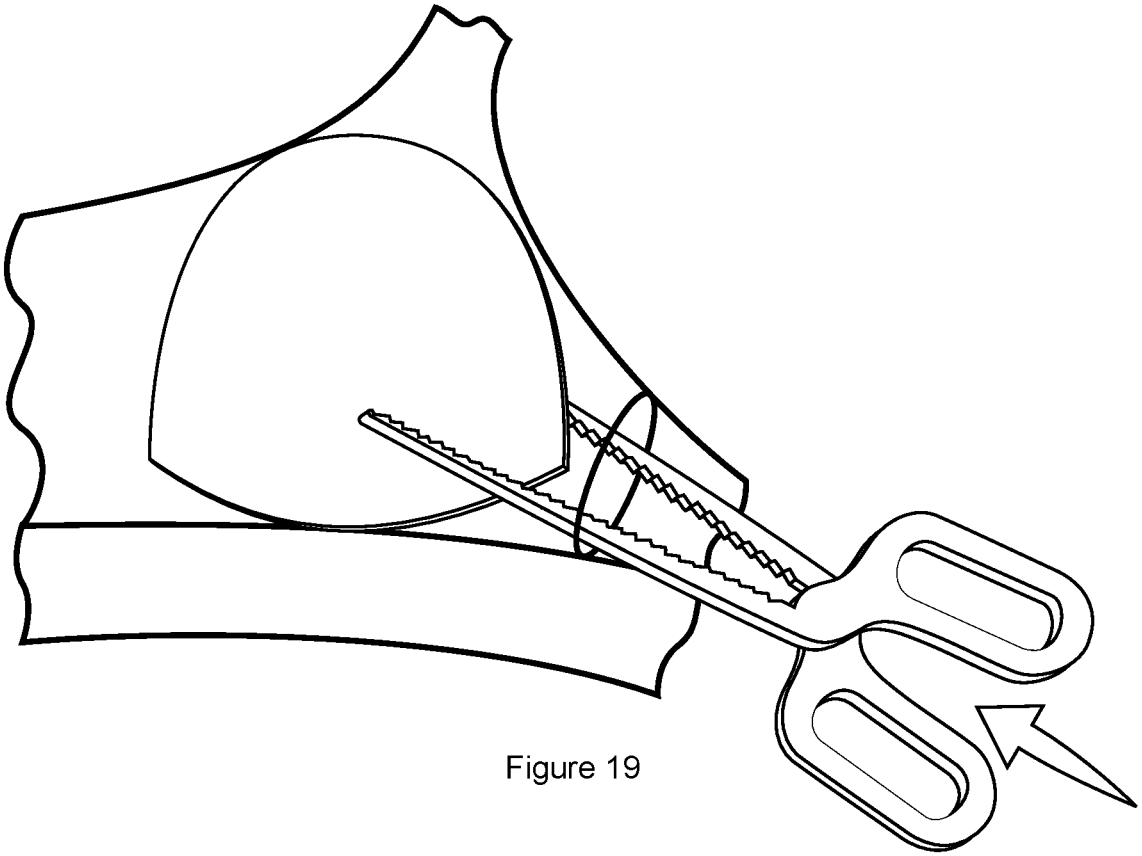

FIG. 19: Tool partially inserted into the article of clothing to remove the insert pad.

Figure 20:
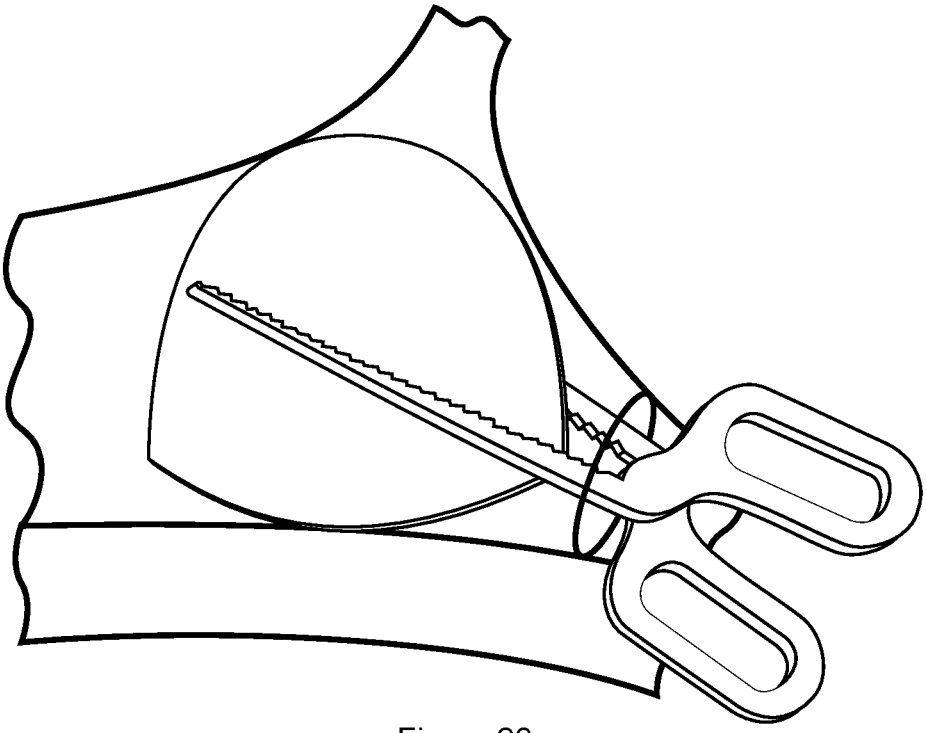

FIG. 20: Alignment of the tool relative to the insert pad for removal.

Figure 21:
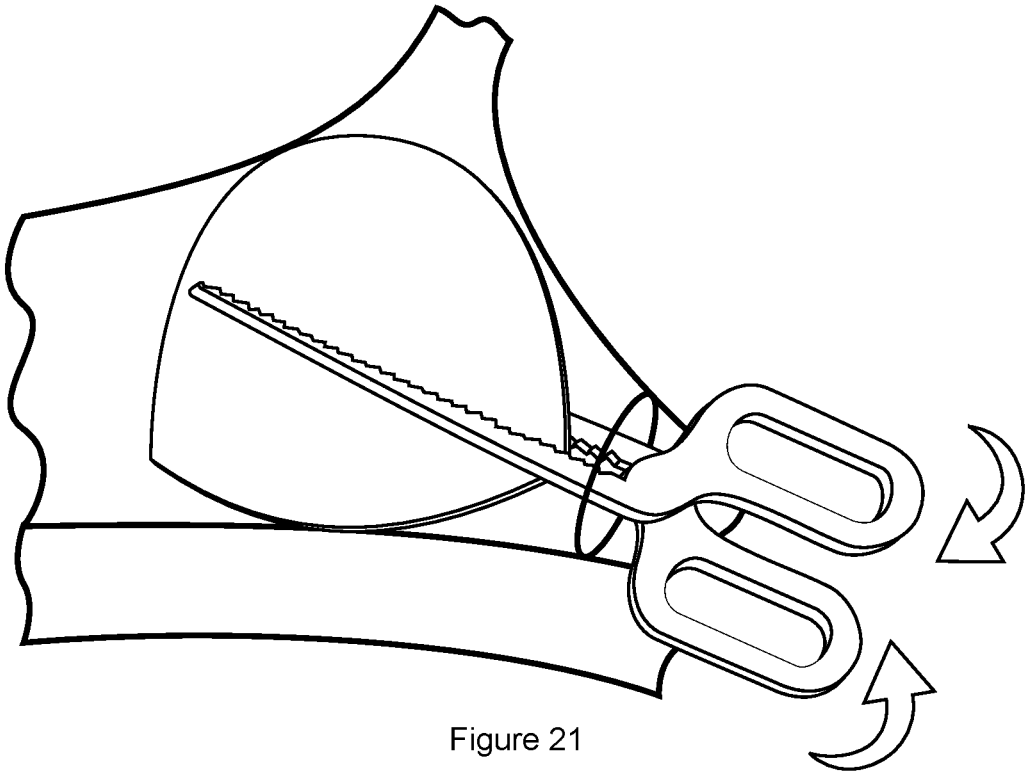

FIG. 21: Insert pad clamped in the jaws of the tool for removal.

Figure 22:
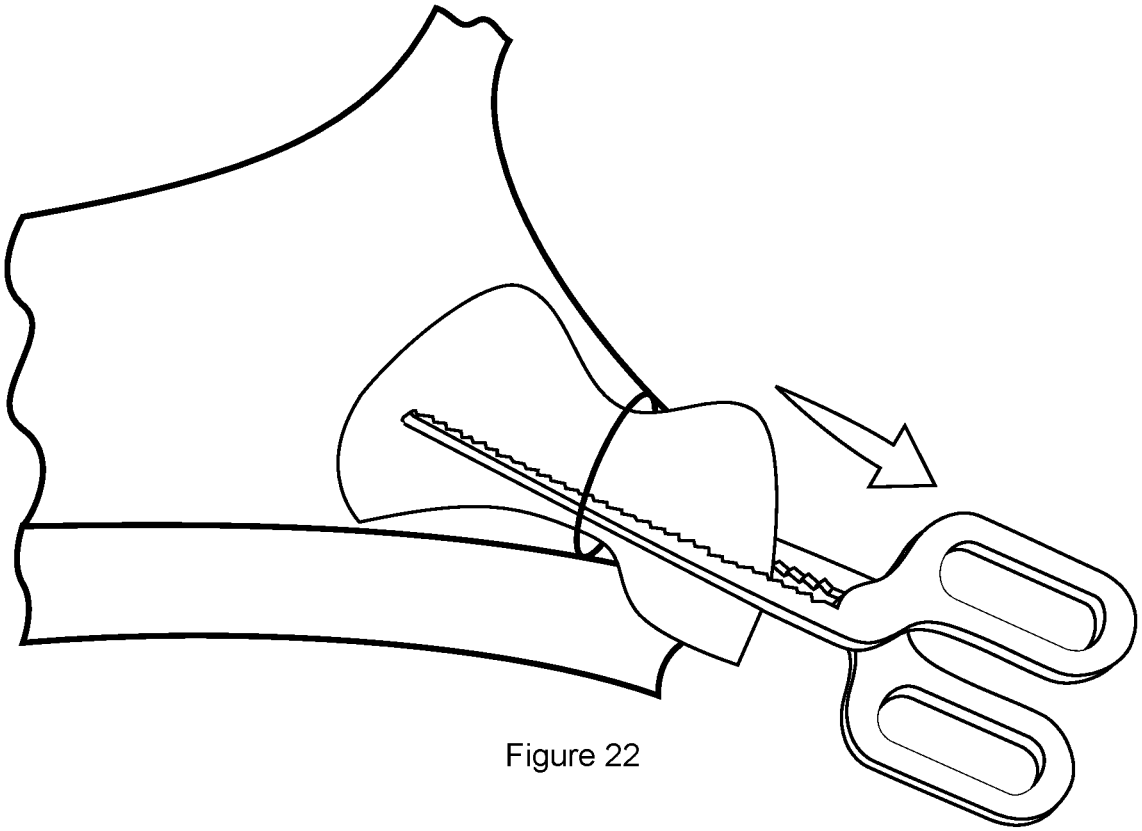

FIG. 22: Tool with clamped insert pad partially removed from the article of clothing.

Figure 23:
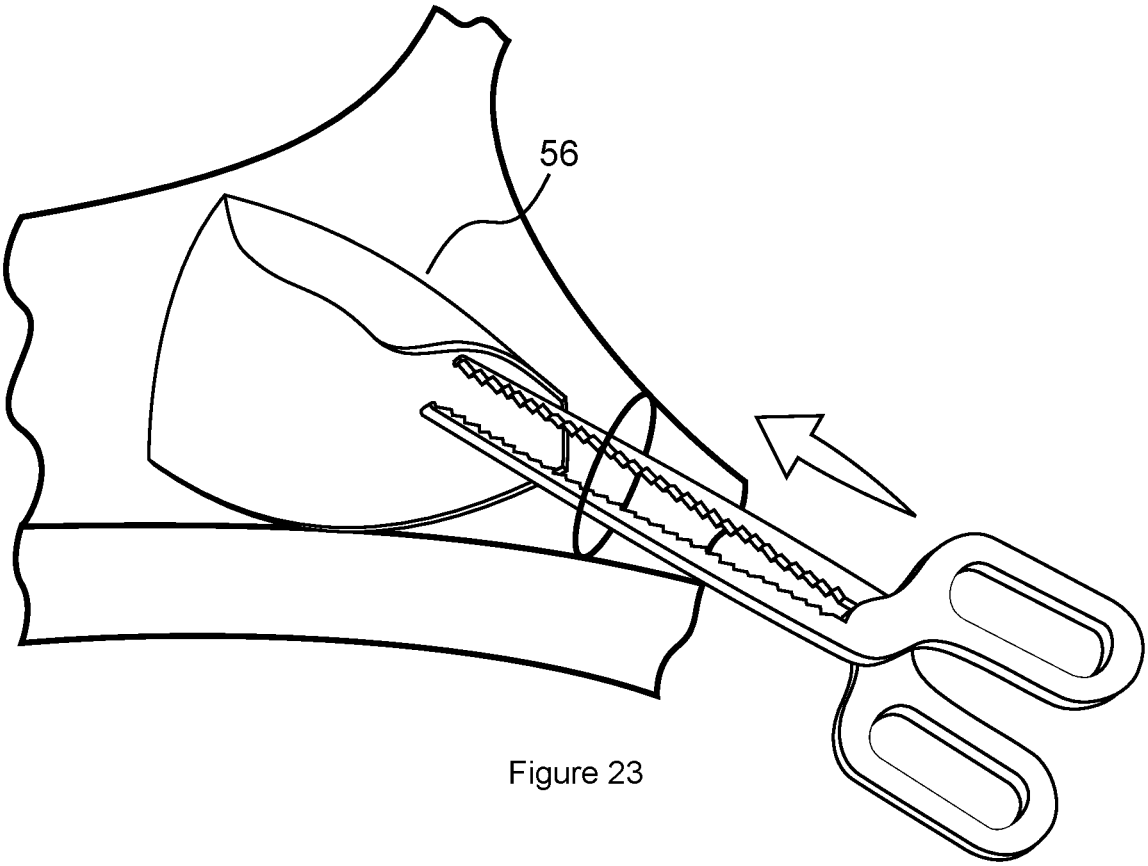

FIG. 23: Tool partially inserted into the article of clothing to adjust an out of place insert pad.

Figure 24:
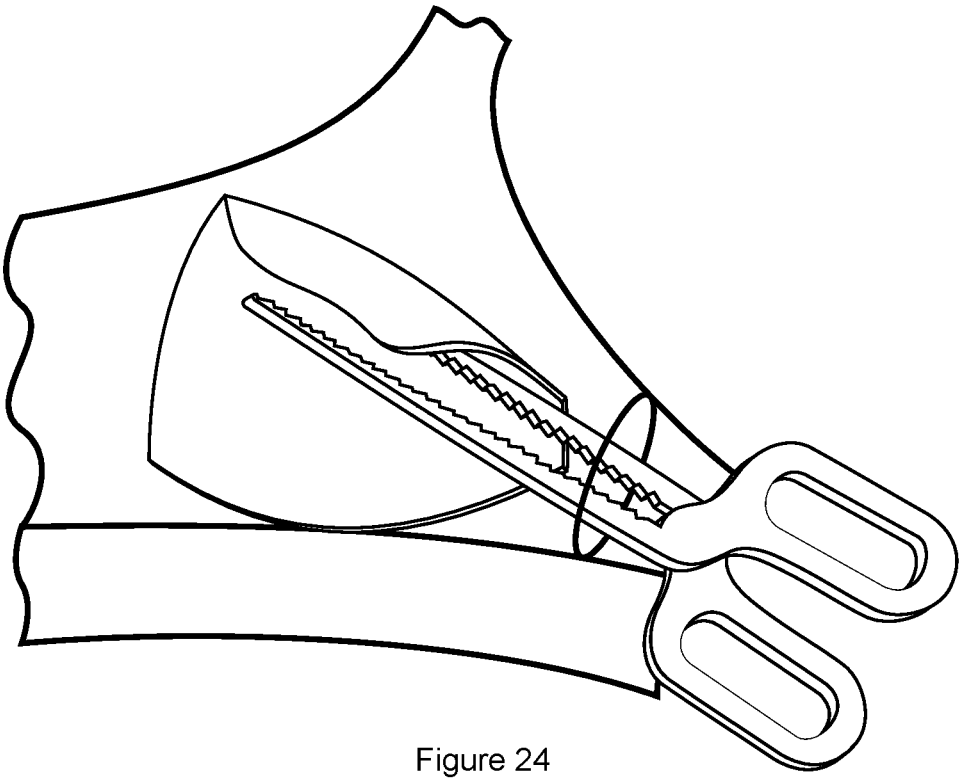

FIG. 24: Alignment of the tool relative to the out of place portion of the insert pad for adjustment.

Figure 25:
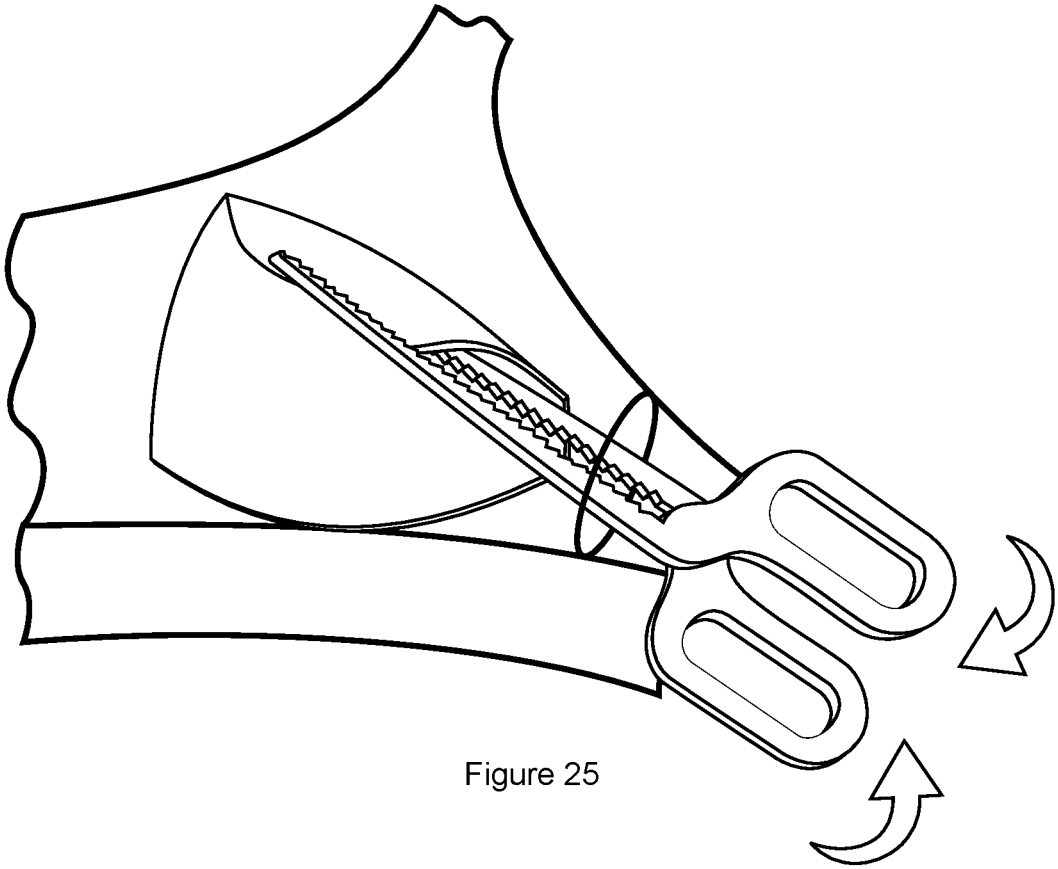

FIG. 25: Out of place portion of the insert pad clamped in the jaws of the tool.

Figure 26:
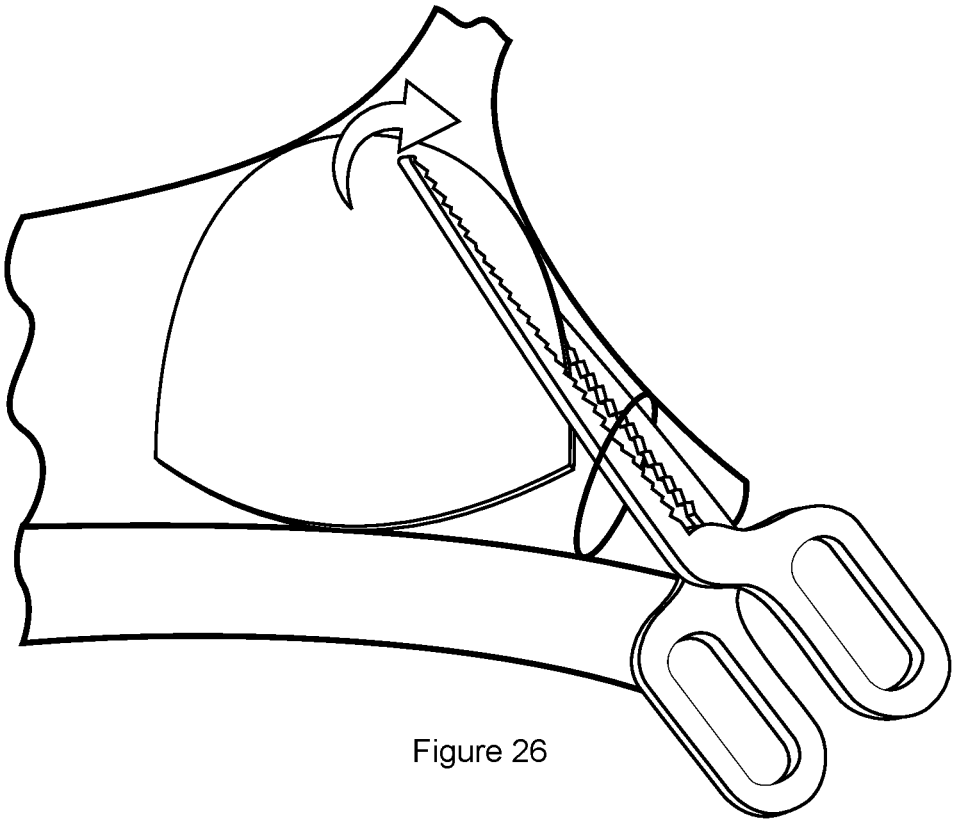

FIG. 26: Tool with clamped portion of the insert pad maneuvered into position.

Figure 27:
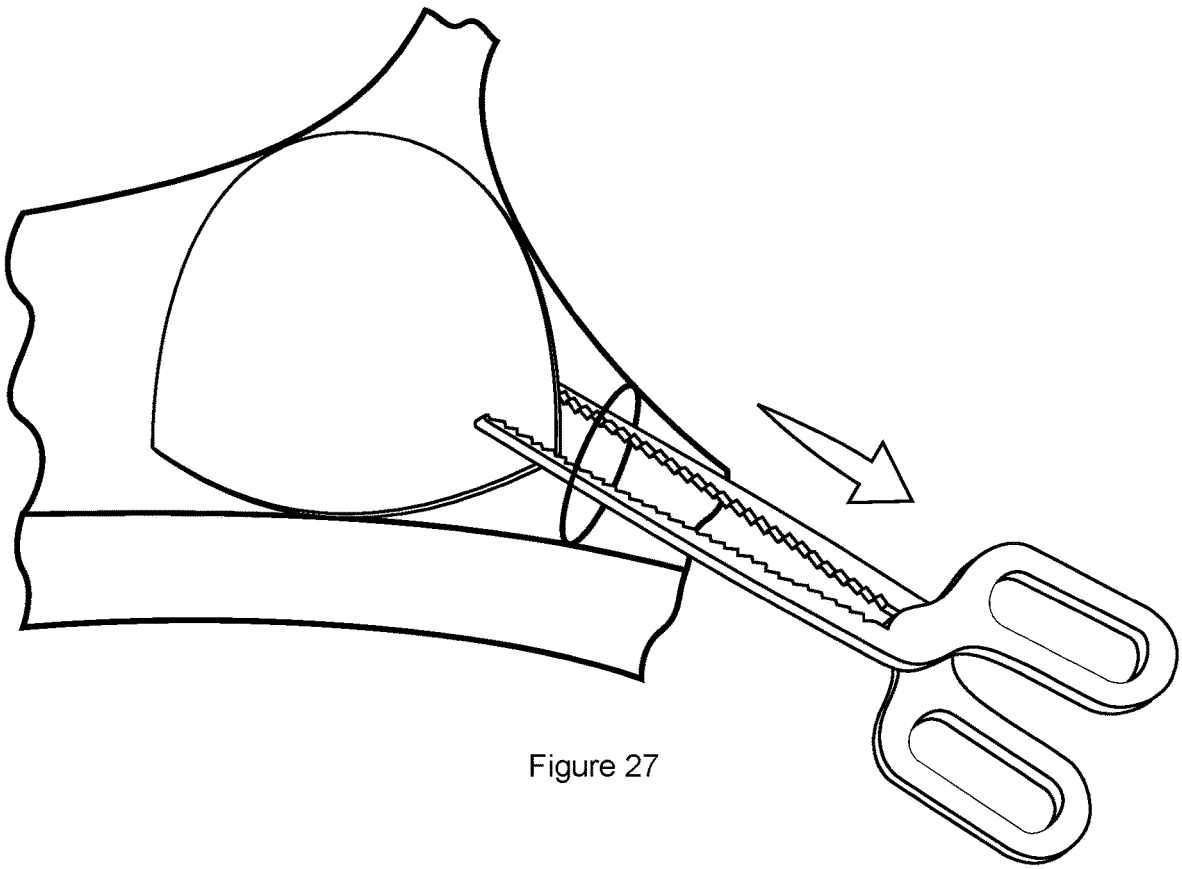

FIG. 27: Tool partially removed from the article of clothing having just adjusted the out of place insert pad.

DRAWINGS—REFERENCE NUMERALS USED

51: A typical clothing insert pad
52: The cup lining of an article of clothing
53: The cup lining access hole located in the side seam of this particular article of clothing
54: A tool, similar to a par off surgical forceps, specially designed for the application of this method
55: The jaws of the tool
56: The out of place portion of the pad
57: An article of clothing, in this case it is shown as a women's brassiere
58: Half A of the tool
59: Half B of the tool
60: The handle of the tool
61: The pivot point that connects half A and half B
62: The compressing surface on the jaw of the tool
63: The smooth outer surface on the jaw of the tool
64: The protrusion of a tooth on the clamping surface of the jaw
65: The hollow of a tooth on the clamping surface of the jaw

DETAILED DESCRIPTION FIGS. 1-5

This application details a method to insert, remove, or adjust, an insert pad (51) into an article of clothing (57). The clothing referred to in this application, generally consists of women's bathing suit tops, sports brassieres, and the shaping pads used in them, but this application applies to any flexible pad or insert which must be inserted, removed, or adjusted, into any cavity which via an opening which is either small relative to the cavity or remotely located. The method, as described here, makes use of a tool which is similar in structure to a surgical forceps. The tool consists of two halves (58,59), each of which have a handle (60) and a jaw (55). The halves are interconnected at a pivot (61) which lies between the handle and jaw for each respective half. The jaw has a toothed compressing surface (62) and a smooth outer surface (63). The toothed compressing surface has teeth structured in such a way as to allow the protrusion of a tooth from one jaw (64) to fit into the hollow of a tooth on the opposing jaw (65). While this is the tool used in this example, in practice significant modifications can be made to suit the need of that use. For instance, the jaws could be hydraulically or electromechanically actuated without affecting the method.

The application consists of 3 independent methods, being: 1) The method for inserting an insert pad (51) into an article of clothing (57); 2) The method for removing an insert pad from an article of clothing; 3) The method for adjusting an insert pad which is already inserted into an article of clothing.

OPERATION FIGS. 6-27

The first independent method of the application comprises a method for inserting an insert pad (51) into an article of clothing. In the preferred embodiment of this method: First, the tool (54) is aligned to the insert pad as seen in FIG. 5. Care should be taken during this step so that the pad will ultimately end up in the correct orientation once inserted. Next, the top of the pad is folded down into the space between the jaws (55) of the tool as seen in FIG. 6. Then the bottom of the shaping pad is folded up into the space between the jaws of the tool as seen in FIG. 7. Next, the tools handles (60) are pressed in such a way as to close the jaws of the tool, grasping the pad as shown in FIG. 8. Then the tool is inserted into the opening (53) in the article of clothing to access the cavity inside as shown in FIG. 9. Once inside, the jaws are opened, allowing the smooth outer surface to unfurl the pad into place. As shown in FIG. 10.

Then the jaws of the tool may be closed again to allow it to be removed from the article of clothing as shown in FIG. 11.

In the secondary embodiment of the method for inserting an insert pad (53) into an article of clothing (57): First, the tool (54) is aligned to one edge of the insert pad as shown in FIG. 13. Then the insert pad is clamped between the jaws (55) of the pad as shown in FIG. 14. Next the pad is completely wrapped around the tool as shown in FIG. 15. Once wrapped, the tool is inserted into the article of clothing as shown in FIG. 16. Then the clamping pressure is released and the tool is used to unroll the pad into position as shown in FIG. 17. Finally, the tool can be closed and removed from the article of clothing as shown in FIG. 18.

The second independent method of the application comprises a method to remove an insert pad (51) from an article of clothing (57). First, the tool (54) is inserted into the article of clothing as shown in FIG. 19. Once inside the article of clothing, the jaws (55) can be placed in such a way that the insert pad is located between them as shown in FIG. 20. Then the jaws can be operated in such a way that they close on the insert pad and clamp it as shown in FIG. 21. Finally the tool can be withdrawn from the article of clothing, allowing the insert pad to compress to fit through the opening as shown in FIG. 22.

The third independent method of the application comprises a method to adjust an insert pad (51) which is already inserted into an article of clothing (57). First, the tool is inserted into the article of clothing as shown in FIG. 23. Then the jaws (55) can be placed in such a way that the out of place portion (56) of the pad is between them as shown in FIG. 24. The insert pad can then be grasped by the tool by operating the jaws to clamp it as shown in FIG. 25. Then the tool can be used to manipulate the clamped portion of the insert pad and maneuver it into position as shown in FIG. 26. Finally, the insert pad can be released by the tool and the tool can be removed from the article of clothing as shown in FIG. 27.

CONCLUSION RAMIFICATIONS AND SCOPE

We have concluded, by using the methods outlined in this application, that the tasks of inserting, removing, and adjusting removable clothing insert pads can be completed much more quickly and with much less effort than before. In this application, significant emphasis has been placed on the use of these methods on articles of clothing. However, they apply to any instance of a pad or sheet of material, which can be rolled, needing to be placed into a cavity via an access opening which is either small or remotely located. Adding a pad under an existing carpeted floor without having to remove the carpet, or applying a patch to the inside of a tank via the filling port are just a couple of examples of how these methods can be applied to other industries and problems. Accordingly, the scope should be determined not by the embodiments illustrated, but by the appended claims and their legal equivalents.

The invention claimed is:

1. A method for inserting a flexible pad into a cavity, within an article of clothing via a small or remotely located access opening comprising:

a) providing a flexible pad and a tool with operable jaws of a dimension similar to the cavity within the article of clothing, the pad will be placed in and, b) wrapping said pad around the operable jaws of said tool, and c) operating the jaws to a closed position such that the pad is held in place, and d) inserting the jaws into the cavity, within the article of clothing, via its available access opening, and e) Operating the jaws to an open position such that the pad is unfurled into the extremities of the cavity, within the article of clothing.

2. A method of removing a flexible pad from a cavity, within an article of clothing, via a small or remotely located access opening comprising:

a) providing a tool with operable jaws and a cavity, within the article of clothing, containing a flexible pad to be removed, and b) inserting the jaws of said tool into said cavity, within the article of clothing, via the access opening, and c) positioning the jaws around the pad to be removed, and d) operating the jaws to the fully closed position such that they grasp the pad over a significant portion of its length, and e) withdrawing the tool from the opening of the article of clothing such that the pad is withdrawn as well.

3. A method of adjusting a flexible pad within a cavity, within an article of clothing, via a small or remotely located access opening comprising:

a) providing a tool with operable jaws and a cavity, within the article of clothing containing a flexible pad to be adjusted, and b) inserting the jaws of said tool into said cavity, within the article of clothing via the access openng, and c) positioning the jaws around the portion of the pad which needs to be adjusted, and d) operating the jaws of the tool to the fully closed position such that they grasp the portion of the pad which needs to be adjusted, and e) manipulating the position or rotation of the tool such that the portion of the pad which needs adjusting is brought to the correct position.

* * * * *